US008991017B2

(12) United States Patent
Hamada et al.

(10) Patent No.: US 8,991,017 B2
(45) Date of Patent: Mar. 31, 2015

(54) SLIDER FOR SLIDE FASTENER

(75) Inventors: Yoshikazu Hamada, Toyama (JP); Keiichi Keyaki, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 14/111,616

(22) PCT Filed: Apr. 15, 2011

(86) PCT No.: PCT/JP2011/059428

§ 371 (c)(1), (2), (4) Date: Oct. 14, 2013

(87) PCT Pub. No.: WO2012/140780

PCT Pub. Date: Oct. 18, 2012

(65) Prior Publication Data

US 2014/0033484 A1 Feb. 6, 2014

(51) Int. Cl.
*A44B 19/30* (2006.01)
*A44B 19/26* (2006.01)

(52) U.S. Cl.
CPC ..... *A44B 19/30* (2013.01); *A44B 19/26* (2013.01); *A44B 19/308* (2013.01)
USPC ..... 24/429; 24/421

(58) Field of Classification Search
USPC ..... 24/419, 421, 429, 418, 420, 424, 430
See application file for complete search history.

(56) References Cited

U.S. PATENT DOCUMENTS 4,624,032 A * 11/1986 Ishii et al. ..... 24/429
4,780,938 A * 11/1988 Ishii ..... 24/429
4,823,447 A * 4/1989 Akashi ..... 24/429

(Continued)

FOREIGN PATENT DOCUMENTS

| | | | |
|---|---|---|---|
| JP | 2-131704 | A | 5/1990 |
| JP | 3078062 | U | 6/2001 |
| JP | 2008-228808 | A | 10/2008 |
| WO | 2010058465 | A1 | 5/2010 |

OTHER PUBLICATIONS

International Preliminary Report on Patentability, PCT Application No. PCT/JP2011/059428, mailed Oct. 15, 2013.

(Continued)

*Primary Examiner* — Robert J Sandy
*Assistant Examiner* — Abigail Morrell
(74) *Attorney, Agent, or Firm* — Kilpatrick Townsend & Stockton LLP

(57) ABSTRACT

There is provided a slider for a slide fastener. A cover member is attached to a body in a cantilever manner to cover a pillar portion and a lock member. An opening/closing member slidably formed between the cover member and the body is configured to open and close an insertion gap. The cover member has a first surface which is formed on the rear end portion of the cover member in substantially parallel to the body, and a second surface extending rearward and upward at a predetermined angle from a rear end portion of the first surface. The opening/closing member has a third surface which overlaps with the first surface in an upward and downward direction and is formed in substantially parallel to the first surface, and a fourth surface extending rearward and downward at a predetermined angle from a rear end portion of the third surface.

2 Claims, 7 Drawing Sheets

(56) References Cited

U.S. PATENT DOCUMENTS

| | | | | |
|---|---|---|---|---|
| 4,829,638 | A * | 5/1989 | Ishii | 24/421 |
| 5,068,950 | A * | 12/1991 | Yuki | 24/429 |
| 7,219,402 | B2 * | 5/2007 | Yamazaki | 24/429 |
| 7,870,650 | B2 * | 1/2011 | Keyaki et al. | 24/424 |
| 2008/0222854 | A1 | 9/2008 | Keyaki et al. | |

OTHER PUBLICATIONS

International Search Report, PCT Application No. PCT/JP2011/059428 mailed Jun. 14, 2011.

Written Opinion, PCT Application No. PCT/JP2011/059428 mailed Jun. 14, 2011.

* cited by examiner

SLIDER FOR SLIDE FASTENER

This application is a national stage application of PCT/JP2011/059428 which is incorporated herein by reference.

TECHNICAL FIELD

The present invention relates to a slider for a slide fastener, and more particularly, to a slider for a slide fastener in which a pull-tab can be easily attached to and detached from a body.

BACKGROUND ART

In the related art, a slider for a slide faster includes a body, a lock member which is swingably supported on the body, a cover member attached to the body in a cantilever manner, with a front end portion thereof being fixed to the upper surface of the body, an opening/closing member which is slidably provided in the body so as to open/close a gap defined between the rear end portion of the cover member and an upper blade of the body, a coil spring which urges the opening/closing member toward a position where the gap is closed, and a pull-tab which is detachably maintained between the body and the cover member (e.g. refer to Patent Document 1).

In the slider for a slide fastener described in Patent Document 1, there is a possibility that a cover member may be deformed since the cover member of the slider is subjected to a load from a number of other sliders when a large number of sliders is being concurrently barrel-polished or since the cover member of the slider is subjected to a load from a wet clothing on which the slider is mounted when the clothing is washed.

Therefore, in the other related art, there is provided a slider for a slide fastener in which a cover member and an opening/closing member can be engaged with each other in order to prevent the cover member from being deformed even if a tensile load or a pressing load is applied to the cover member (e.g. refer to Patent Document 2).

PRIOR ART DOCUMENT

Patent Document

Patent Document 1: Japanese Patent Application Publication No. 2008-228808A

Patent Document 2: WO 2010/058465 A1

SUMMARY OF INVENTION

Problems to Be Solved by Invention

However, in the slider for a slide fastener described in Patent Document 2, it is difficult to insert a shaft portion of the pull-tab into an insert gap between the cover member and an upper blade when mounting the pull-tab to the slider, and therefore an improvement has been required.

Accordingly, the present invention has been made keeping in mind the above problems, and an object of the present invention is to provide a slider for a slide fastener which can prevent a cover member from being deformed and facilitate insertion of a pull-tab into an insertion gap.

Means for Solving Problems

The object of the present invention is achieved by the following configurations.

(1) A slider for a slide fastener including: a body; a lock member which is swingably supported by a pillar portion which is erected on an upper surface of the body; a cover member which is attached to the body in a cantilever manner, with a front end portion thereof being fixed to the upper surface of the body, and covers the pillar portion and the lock member from above; and an opening/closing member which is formed between a rear end portion of the cover member and the body, and is configured to open and close a gap into which a shaft portion of a pull-tab is inserted, wherein the opening/closing member is provided so as to be slidable in a front-rear direction with respect to the body, wherein the cover member has a first surface which is formed on the rear end portion of the cover member in substantially parallel to the body, and a second surface extending rearward and upward at a predetermined angle from a rear end portion of the first surface, and wherein the opening/closing member has a third surface which overlaps with the first surface in an upward and downward direction and is formed in substantially parallel to the first surface, and a fourth surface extending rearward and downward at an predetermined angle from a rear end portion of the third surface.

(2) The slider for a slide fastener according to (1), wherein an angle of the second surface with respect to the first surface is set to be smaller than an angle of the fourth surface with respect to the third surface.

(3) The slider for a slide fastener according to (1) or (2), wherein the cover member has a top plate, a pair of right and left side plates extending downward from both side edges of the top plate, a front plate extending downward from a front end portion of the top plate, and a rear plate extending downward from a rear end portion of the top plate, and wherein the second surface is formed by a whole area of a lower end surface of the rear plate.

Advantageous Effects of Invention

In the slider for a slide fastener according to the present invention, the cover member has the first surface which is formed on the rear end portion of the cover member in substantially parallel to the body and the second surface extending rearward and upward at the predetermined angle from the rear end portion of the first surface, and the opening/closing member has the third surface which overlaps with the first surface in the upward and downward direction and is formed in substantially parallel to the first surface and the fourth surface extending rearward and downward at a certain angle from the rear end portion of the third surface. When a force is applied to the rear end portion of the cover member from above, the first surface of the cover member comes into contact with the third surface of the opening/closing member, thereby preventing the cover member from being deformed. In addition, since the portion which receives the shaft portion of the pull-tab can be widened by the second surface extending rearward and upward and the fourth surface extending rearward and downward, it is possible to facilitate insertion of the pull-tab into the insertion gap.

EMBODIMENTS OF INVENTION

Hereinafter, embodiments of a slider for a slide fastener according to the present invention will be described in detail with reference to the accompanying drawings. In the following description, an upper side refers to the upper side with respect to the paper surface of FIG. 2, a lower side refers to the lower side with respect to the paper surface of FIG. 2, a front side refers to the left side with respect to the paper surface of FIG. 2, a rear side refers to the right side with respect to the paper surface of FIG. 2, a right side refers to the far side with respect to the paper surface of FIG. 2, and the left side refers to the near side with respect to the paper surface of FIG. 2. In addition, the right and left direction of the slider is also referred to as the width direction.

Figure 1:
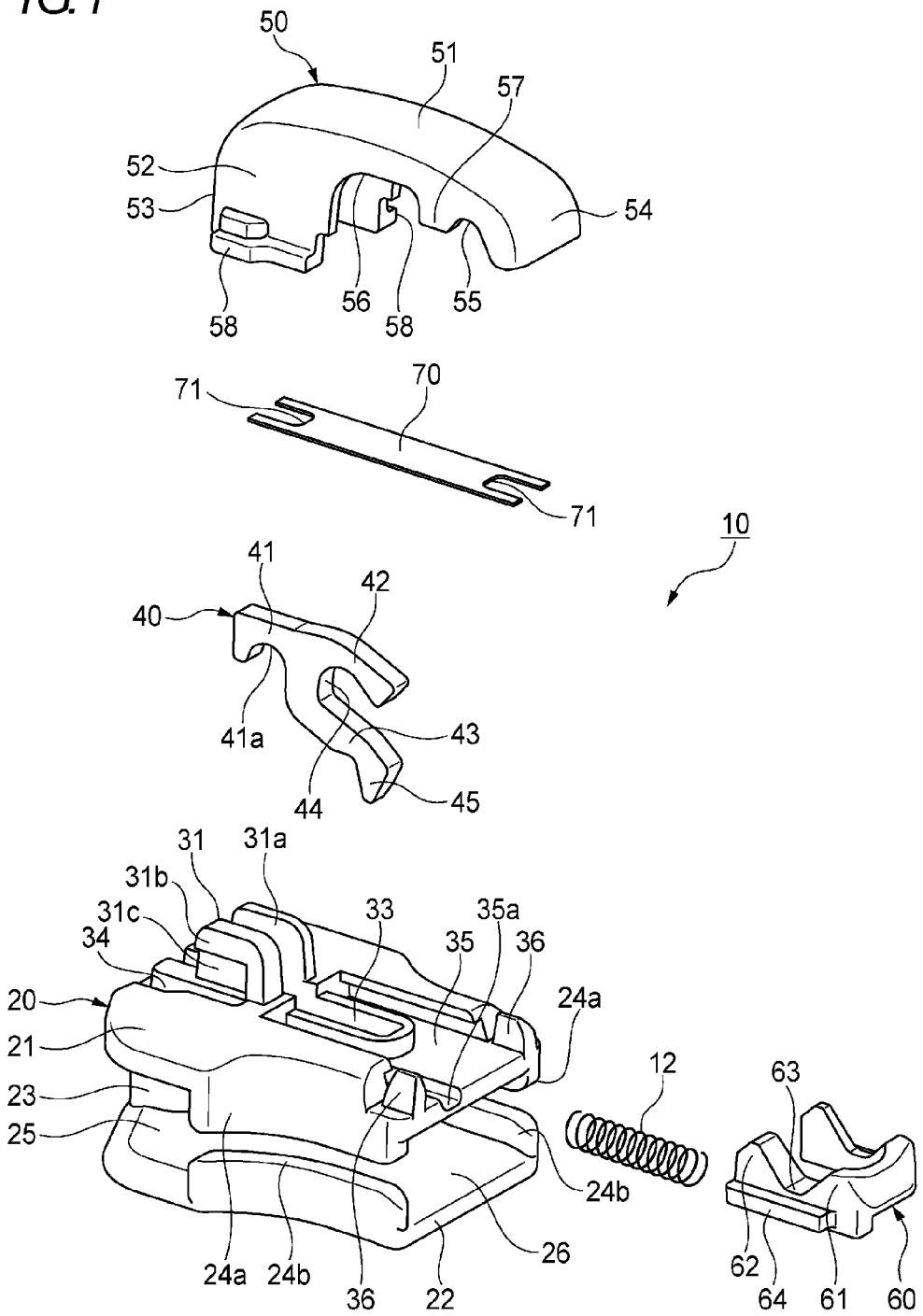
FIG. 1 is an exploded perspective view showing an embodiment of a slider for a slide fastener according to the present invention.
Figure 2:
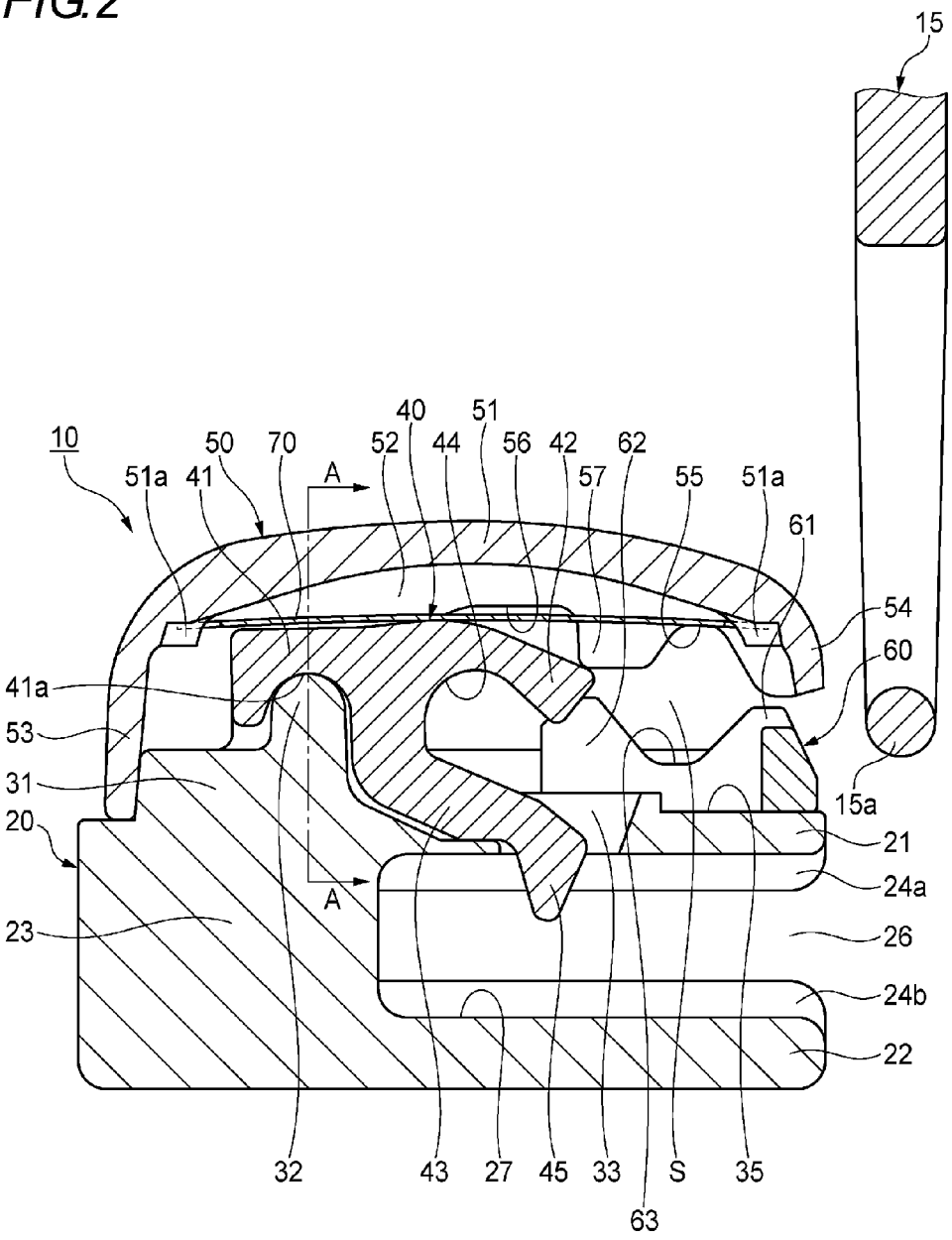
FIG. 2 is a vertical cross-sectional view of the slider for a slide fastener shown in FIG. 1 where a pull-tab is not mounted.

The slider for a slide fastener 10 according to this embodiment is a slider with an automatic stop function, and as shown in FIG. 1 and FIG. 2, the slider 10 has a body 20. The body 20 includes an upper blade 21 and a lower blade 22 which are spaced apart from each other in the upward and downward direction so as to be disposed in parallel to each other, a guide post 23 which connect the front end portions of the upper blade 21 and the lower blade 22 to each other, upper flanges 24*a* which protrude downward along right and left side edges of the upper blade 21, and lower flanges 24*b* which protrude upward along right and left side edges of the lower blade. Due to this configuration, right and left shoulder mouths 25 which are separated by the guide post 23 are formed in the front portion of the body 20, and a rear mouth 26 is formed in the rear portion of the body 20. In addition, an element guide path 27 which is formed into a substantially Y-shape is formed between the upper blade 21 and the lower blade 22 to communicate the right and left shoulder mouths 25 with the rear mouth 26. The element guide path 27 constitutes a path into which fastener element rows (not shown) are inserted.

In addition, the slider for a slide fastener 10 includes a lock member 40, a cover member 50 and an opening/closing member 60. The lock member 40 is supported by a pillar portion 31 so as to be swingable up and down, the pillar portion 31 being erected on the front end portion of the upper surface of the upper blade 21. The cover member 50 is attached to the upper blade 21 in a cantilever manner, with a front end portion thereof being fixed to the upper surface of the upper blade 21. The cover member 50 covers the pillar portion 31 and the lock member 40 from above. The opening/closing member 60 is formed between the rear end portion of the cover member 50 and the upper blade 21, and is configured to open/close a gap S (hereinafter referred to as "insertion gap S") into which a shaft portion 15*a* of the pull-tab 15 is inserted.

The pillar portion 31 has left and right wall portions 31*a*, 31*b* which are spaced apart from each other at a gap into which the lock member 40 can be fitted, and a support convex portion 32 which is formed between the left and right wall portions 31*a*, 31*b*.

As shown in FIG. 1 and FIG. 2, the lock member 40 has a base portion 41 which is supported on the pillar portion 31 of the body 20, an upper piece portion 42 and a lower piece portion 43 which respectively extend rearward from the base portion 41 and are disposed so as to face each other in the upward and downward direction, and an operation recess portion 44 which is formed between the upper piece portion 42 and the lower piece portion 43. The operation recess portion 44 is opened toward the rear mouth 26 to accommodate the shaft portion 15*a* of the pull-tab 15 in a pull-tab attachment state.

In addition, a claw portion 45 configured to enter the element guide path 27 through a claw hole 33 formed in the upper blade 21 is formed downward at a tip end portion of the lower piece portion 43. In addition, a support concave portion 41*a* which is fitted into the support convex portion 32 of the pillar portion 31 is formed in a lower surface of the base portion 41. The support recess portion 41*a* is supported by the support convex portion 32 so as to be swingable in the upward and downward direction. The claw hole 33 penetrates from the upper surface of the upper blade 21 to the element guide path 27.

Figure 3:
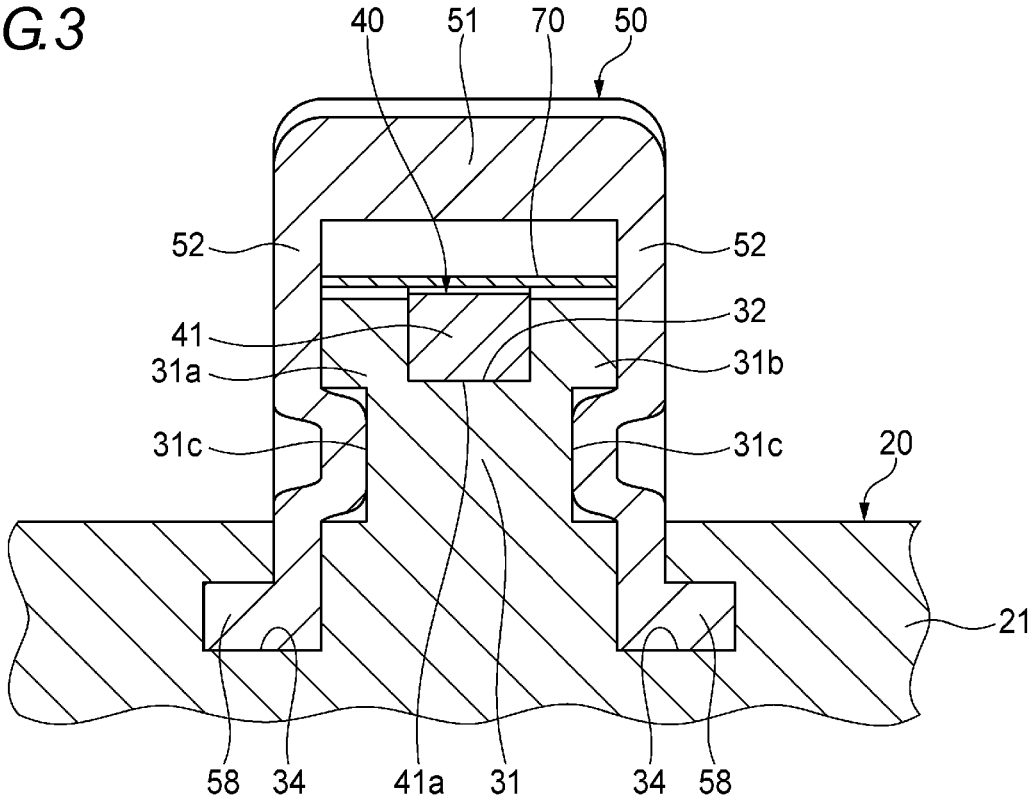
FIG. 3 is a cross-sectional view taken along line A-A in FIG. 2.

As shown in FIG. 1 to FIG. 3, the cover member 50 has a top plate 51 which is bent so as to be convex upward, a pair of right and left side plates 52 extending downward from both side edges of the top plate 51, a front plate 53 extending downward from the front end portion of the top plate 51, and a rear plate 54 extending downward from the rear end portion of the top plate 51. A retracting portion 55 and a pull-tab accommodating portion 56 are formed in the lower end surfaces of the pair of right and left side plates 52 in the middle portion of the cover member 50. The retracting portion 55 and the pull-tab accommodating portion 56 are configured so as to be concave downward and face the body 20. A protrusion 57 extending downward is formed between the retracting portion 55 and the pull-tab accommodating portion 56.

In addition, fitting pieces 58 are respectively formed on the lower end portion of the pair of right and left side plates 52 at the front end side of the pair of right and left side plates 52. The fitting pieces 58 are fitted into fitting recesses 34 which are formed in the front end portion of the upper blade 21. In addition, when the fitting pieces 58 are fitted into the fitting recesses 34 and the pair of right and left side plates 52 are crimped into the recesses 31*c* which are formed in the outer side surfaces of the left and right wall portions 31*a*, 31*b* of the pillar portion 31, the cover member 50 is attached to the body 20 in a cantilever manner along the front-rear direction, with the front end portion thereof being fixed to the front end portion of the upper blade 21. In addition, the fitting recesses 34 are respectively formed at the right and left of the pillar portion 31, and extend in the front-rear direction of the body 20. The fitting pieces 58 protrude sideward from the lower ends of the pair of right and left side plates 52 of the cover member 50.

A rectangular leaf spring 70 which urges the claw portion 45 of the lock member 40 so as to enter the element guide path 72 is provided between the lock member 40 and the cover member 50. The front and rear end portions of the leaf spring 70 are respectively provided with engagement recess portions 71. When the front and rear engagement recess portions 71 are engaged with engagement convex portions 51*a* which are formed on the front and rear portions of the top plate 51 of the cover member 50, the leaf spring 70 is mounted inside the cover member 50. The engagement convex portions 51*a* are disposed inside the cover member 50 (i.e. inside the space surrounded by the top plate 51, the pair of right and left side plates 52, the front plate 53 and the rear plate 54).

The opening/closing member 60 has a first closing portion 61, a second closing portion 62 and a valley portion 63, as shown in FIG. 1 and FIG. 2. The opening/closing member 60 is formed into a substantially U-shape when viewed in a top plan view so as not to come into contact with the lock member 40 in a state in which the opening/closing member 60 is attached to the body 20. The first closing portion 61 is formed on the rear end portion of the opening/closing member 60, and is formed into a substantially trapezoidal shape when viewed from the side. The second closing portion 62 is formed on the front end portion of the opening/closing member 60, and is formed into a substantially trapezoidal shape when viewed from the side. The valley portion 63 is provided between the first closing portion 61 and the second closing portion 62.

The lower end portions of both side surfaces of the opening/closing member 60 are respectively formed with guide portions 64 which are slidably fitted into guide recesses 35 which are formed along the front-rear direction in the upper surface of the upper blade 21 at the rear portion of the upper blade 21. Due to this configuration, the opening/closing member is provided so as to be slidable in the front-rear direction with respect to the body 20. In addition, a coil spring 12 is provided in a compressed manner between the front end portion of the opening/closing member 60 and a spring-maintaining recess 35*a* formed in the guide recess 35. The opening/closing member 60 is constantly urged toward the rear mouth 26 by an urging force of the coil spring 12.

A pair of right and left stoppers 36 is formed on the rear end portion of the upper surface of the upper blade 21. The stoppers 36 are configured to stop the opening/closing member 60 at a gap closing position where the insertion gap S is closed and to prevent the opening/closing member 60 from being disengage from the guide recess 35. When the opening/closing member 60 slides toward a gap opening position where the insertion gap S is opened and the shaft portion 15*a* of the pull-tab 15 is inserted into the insertion gap S, the shaft portion 15*a* is accommodated inside the operation recess portion 44 of the lock member 40.

Figure 4:
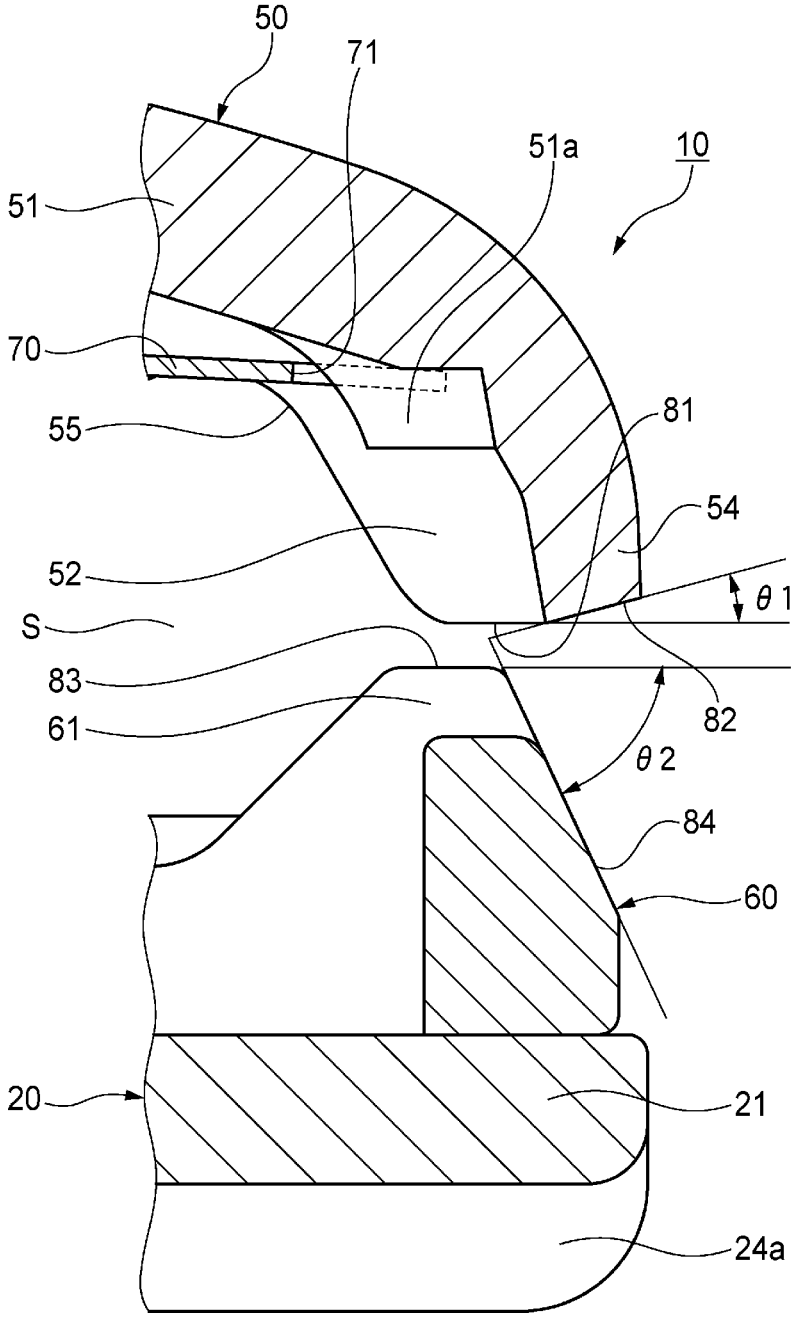
FIG. 4 is an enlarged vertical cross-sectional view of the surroundings of the rear end portion of the cover member shown in FIG. 2.

According to this embodiment, as shown in FIG. 4, a first surface 81 is formed on the lower end surface of the pair of right and left side plates 52 of the cover member 50 at the rear end side of the side plates 52 such that the first surface 81 is substantially parallel to the upper blade 21. A second surface 82 is formed on the lower end surface of the rear plate 54 of the cover member 50 such that the second surface 82 extends rearward and upward at a certain angle from the rear end portion of the first surface 81. Second surface 82 is an inclined surface that extends linearly. The second surface 82 is a surface that extends toward the rear side of the body 20 such that it is gradually spaced away from the body 20. The second surface 82 is a surface that is inclined upward at an angle θ1 ranging from 10° to 20° with respect to the first surface 81.

The first closing portion 61 of the opening/closing member 60 has a third surface 83 which is the upper surface of the first closing portion 61 and is formed in substantially parallel to the first surface 81 such that the third surface 83 overlaps with the first surface 81 in the upward and downward direction, and a fourth surface 84 which extends rearward and downward at a certain angle from the rear end portion of the third surface 83. The fourth surface 84 is an inclined surface that extends linearly. The fourth surface 84 is a surface that extends toward the rear side of the body 20 such that it is gradually spaced away from the cover member 50. The fourth surface 84 is a surface that is inclined downward at an angle θ2 ranging from 60° to 70° with respect to the third surface 83.

Figure 5:
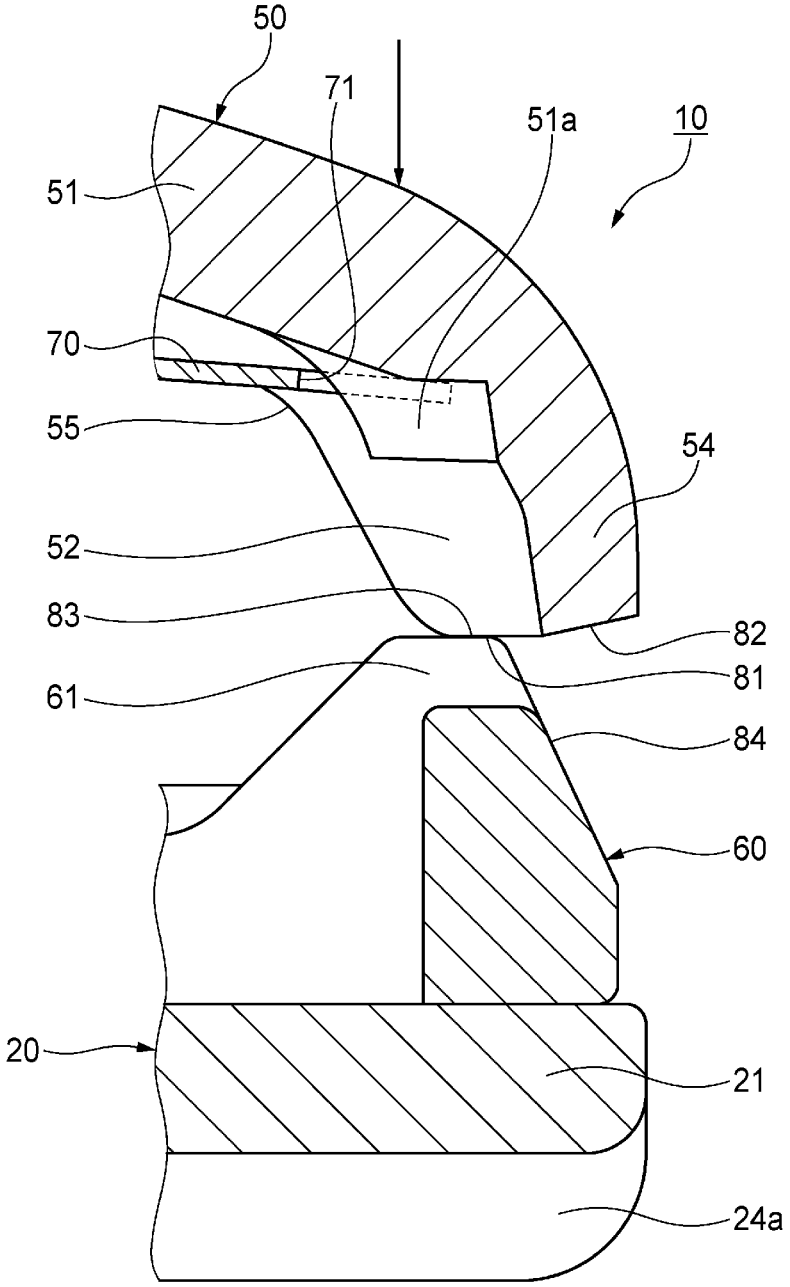
FIG. 5 is an enlarged vertical cross-sectional view showing a state in which a first surface of the cover member comes in contact with a third surface of an opening/closing member.

Due to this configuration, even when a force is applied to the rear end portion of the cover member 50 from above, the first surface 81 of the cover member 50 comes into contact with the third surface 83 of the opening/closing member 60, as shown in FIG. 5, thereby preventing the cover member 50 from being deformed.

According to this embodiment, the angle defined between the second surface 82 of the cover member 50 and the fourth surface 84 of the opening/closing member 60 is set to about 80°. It is preferred that this angle ranges from 70° to 90° (θ1+θ2). This makes it possible to widen the portion which receives the shaft portion 15*a* of the pull-tab 15, thereby facilitating insertion of the pull-tab 15 into the insertion gap S. The angle θ1 of the second surface 82 is set to be smaller than the angle θ2 of the fourth surface 84.

According to this embodiment, the second surface 82 is formed by the whole area of the lower end surface of the rear plate 54 of the cover member 50. However, this is not intended to be limiting, but the second surface 82 may be a surface that extends beyond the lower end surface of the rear plate 54 to the lower end surfaces of the right and left side plates 52. In addition, the starting point of the second surface 82, i.e. the point of intersection between the first surface 81 and the second surface 82, is positioned at the rear side of the body 20 relative to the point of intersection between the third surface 83 and the fourth surface 84 of the opening/closing member 60. In addition, the lower surface of the rear plate 54 (the second surface 82) is not positioned above the third surface 83 but is positioned behind the body 20 relative to the third surface 82 and above the fourth surface 84.

Here, the front end portion of the cover member 50 according to this embodiment indicates a portion that includes the front plate 53 and the fitting portions 58 of the pair of right and left side plates 52. The rear end portion of the cover member 50 indicates a portion that includes the rear plate 54 and the first surfaces 81 of the right and left side plates 52. The middle portion of the cover member 50 indicates a portion between the front end portion and the rear end portion of the cover member 50.

Next, referring to FIG. 6 to FIG. 9, a description will be given below of the sequence of attaching the pull-tab 15 to the slider for a slide fastener 10.

Figure 6:
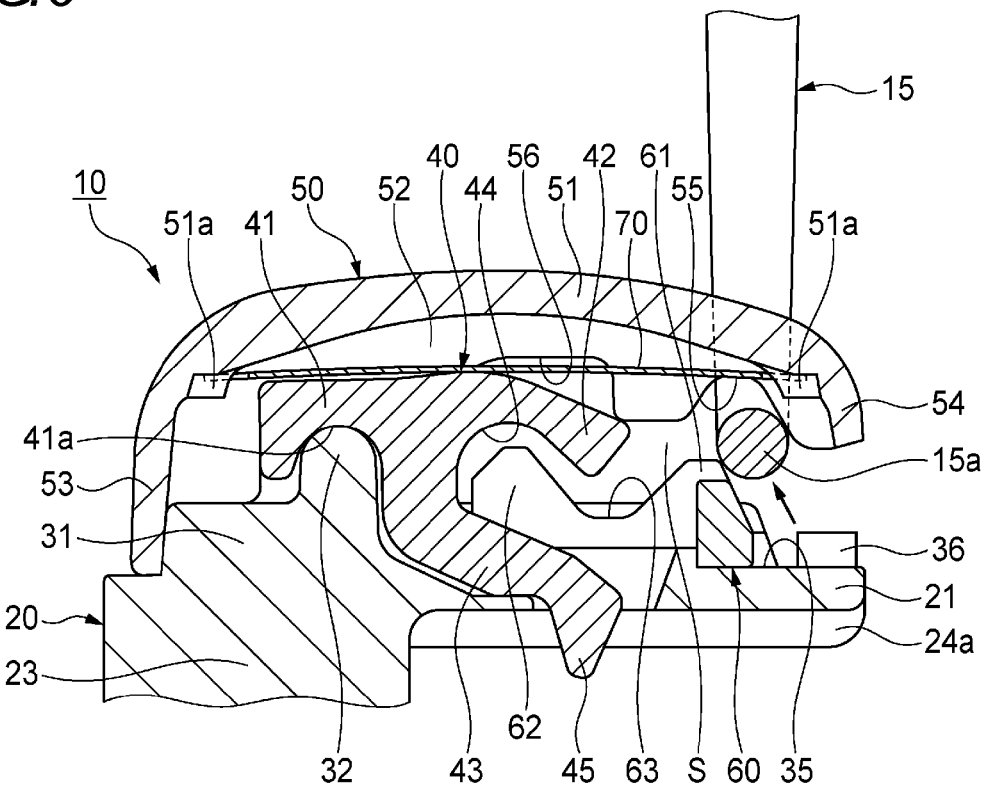
FIG. 6 is a vertical cross-sectional view of the slider for illustrating a state in which a shaft portion of the pull-tab is pushed into an insertion gap.
Figure 7:
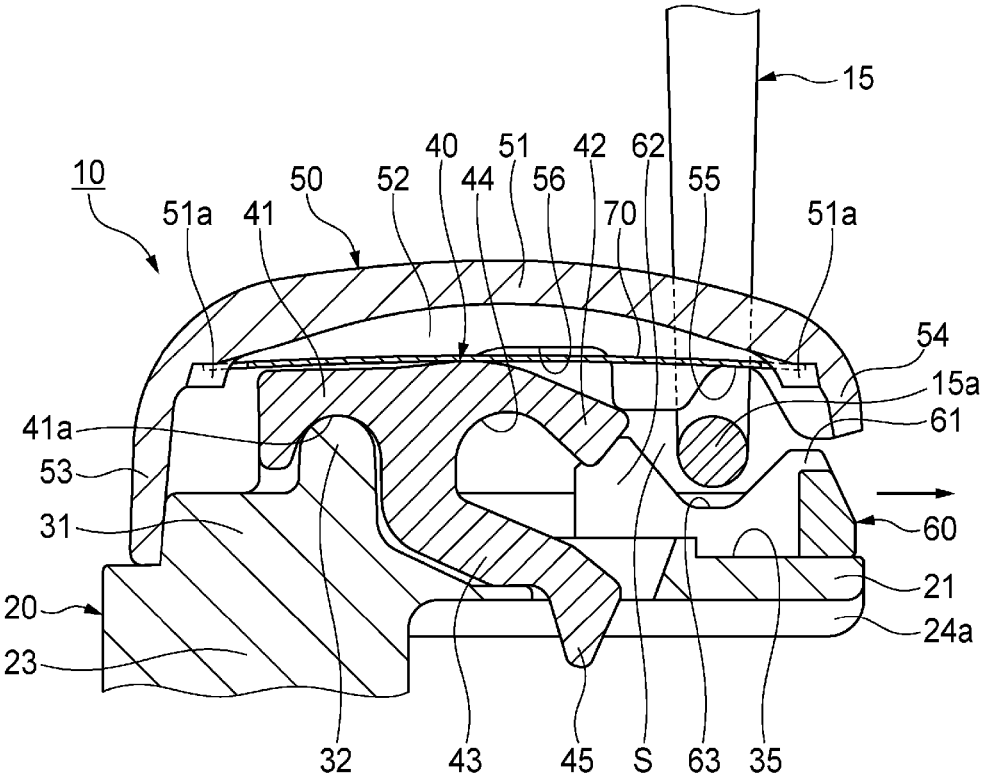
FIG. 7 is a vertical cross-sectional view of the slider for illustrating a state in which the shaft portion of the pull-tab enters a valley of the opening/closing member.

First, as shown in FIG. 6, when the shaft portion 15*a* of the pull-tab 15 is pushed into the insertion gap S from rear to front, the opening/closing member 60 slides forward so that the shaft portion 15*a* of the pull-tab 15 is retracted into the retraction portion 55 of the cover member 50. Then, as shown in FIG. 7, the opening/closing member 60 slides rearward so that the shaft portion 15*a* of the pull-tab 15 enters the valley portion 63 between the first closing portion 61 and the second closing portion 62 of the opening/closing member 60.

Figure 8:
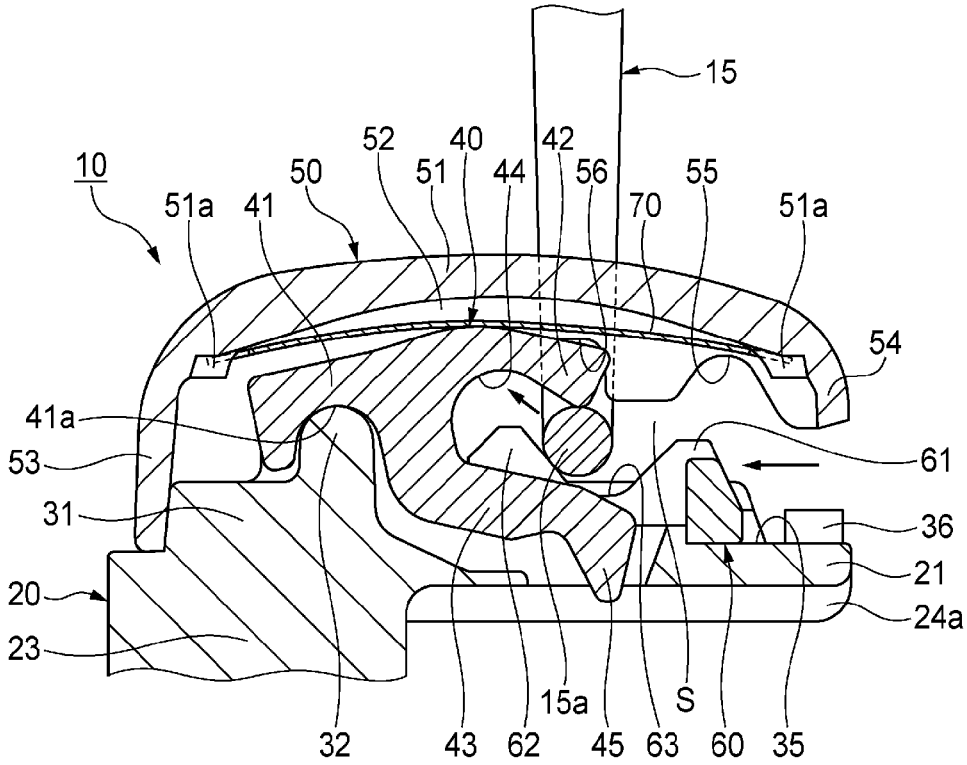
FIG. 8 is a vertical cross-sectional view of the slider for illustrating a state in which the shaft portion of the pull-tab is further pushed into the insertion gap.
Figure 9:
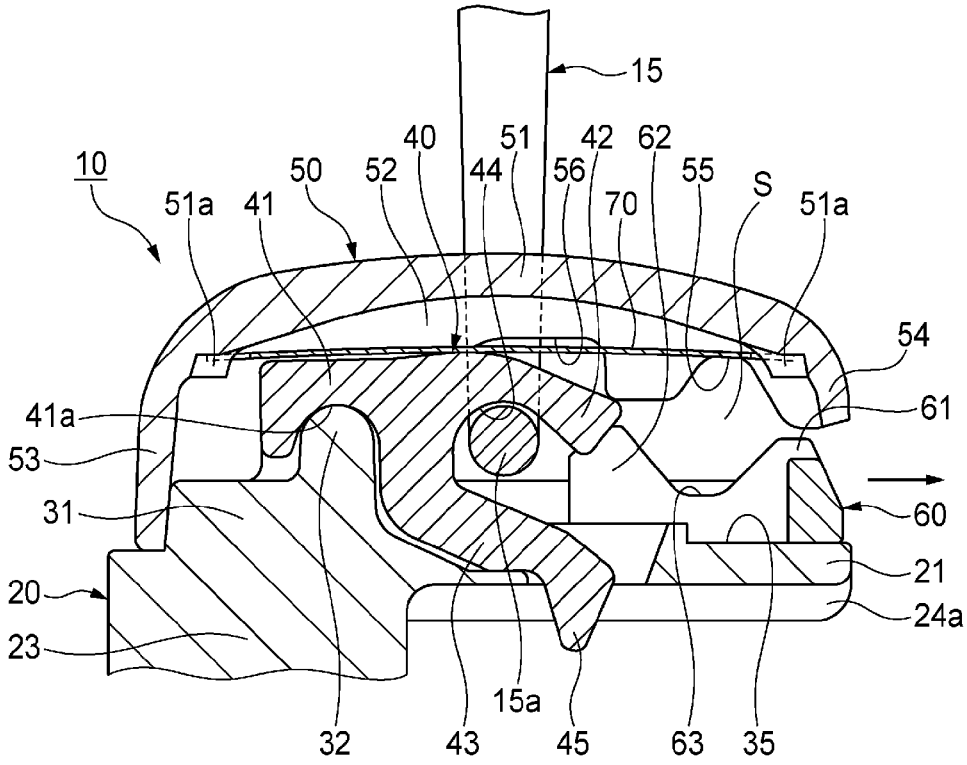
FIG. 9 is a vertical cross-sectional view of the slider for illustrating a state in which the shaft portion of the pull-tab is accommodated in an operation recess portion of the lock member.

Afterwards, as shown in FIG. 8, when the shaft portion 15*a* of the pull-tab 15 is pushed further forward in the insertion gap S, the opening/closing member 60 slides forward so that the shaft portion 15*a* of the pull-tab 15 enters the pull-tab accommodating portion 56 of the cover member 50 while lifting up the lock member 40. Then, as shown in FIG. 9, the opening/closing member 60 slides rearward so that the shaft portion 15*a* of the pull-tab 15 is accommodated inside the operation recess portion 44 of the lock member 40.

In the slider for a slide fastener 10 according to this embodiment as described above, the cover member 50 has the first surface 81 which is formed on the rear end portion of the cover member 50 in substantially parallel to the upper blade 21, and the second surface 82 extending rearward and upward at a certain angle from the rear end portion of the first surface 81, and the opening/closing member 60 has the third surface 83 which overlaps with the first surface 81 in the upward and downward direction and is formed in substantially parallel to the first surface 81, and the fourth surface 84 extending rearward and downward at a certain angle from the rear end portion of the third surface 83. When a force is applied to the rear end portion of the cover member 50 from above, the first surface 81 of the cover member 50 comes into contact with the third surface 83 of the opening/closing member 60, thereby preventing the cover member 50 from being deformed. In addition, since the portion which receives the shaft portion 15*a* of the pull-tab 15 can be widened by the second surface 82 extending rearward and upward and the fourth surface 84 extending rearward and downward, it is possible to facilitate insertion of the pull-tab 15 into the insertion gap S.

The present invention is not limited to those that were illustrated in the foregoing embodiments but can be suitably changed without departing from the concept of the present invention.

DESCRIPTION OF REFERENCE NUMERALS

10: Slider for Slide Fastener
20: Body
21: Upper Blade
31: Pillar Portion
40: Lock Member
50: Cover Member
51: Top Plate
52: Side Plate
53: Front Plate
54: Rear Plate
60: Opening/Closing Member
61: First Closing Portion
62: Second Closing Portion
81: First Surface
82: Second Surface
83: Third Surface
84: Fourth Surface
15: Pull-Tab
15A: Shaft Portion
S: Insertion Gap
θ1: Angle of Second Surface
θ2: Angle of Fourth Surface

The invention claimed is:

1. A slider for a slide fastener comprising:

a body;

a lock member which is swingably supported by a pillar portion which is erected on an upper surface of the body;

a cover member which is attached to the body in a cantilever manner, with a front end portion thereof being fixed to the upper surface of the body, and covers the pillar portion and the lock member from above; and an opening/closing member which is formed between a rear end portion of the cover member and the body, and is configured to open and close a gap into which a shaft portion of a pull-tab is inserted, wherein the opening/closing member is provided so as to be slidable in a front-rear direction with respect to the body, wherein the cover member has a first surface which is formed on the rear end portion of the cover member and is substantially parallel to the body, and a second surface extending rearward and upward at a first predetermined angle from a rear end portion of the first surface, and wherein the opening/closing member has a third surface disposed under the first surface and formed substantially parallel to the first surface, and a fourth surface extending rearward and downward at a second predetermined angle from a rear end portion of the third surface, wherein the cover member has a top plate, a right side plate extending downward from a right side edge of the top plate, a left side plate extending downward from a left side edge of the top plate, a front plate extending downward from a front end portion of the top plate, and a rear plate extending downward from a rear end portion of the top plate, wherein the second surface is formed by a whole area of a lower end surface of the rear plate, and wherein the first surface is formed on a lower end surface of the right side plate at a rear end side of the right side plate or on a lower end surface of the left side plate at a rear end side of the left side plate, and the first surface is not formed on the lower end surface of the rear plate.

2. The slider according to claim 1, wherein the first predetermined angle of the second surface with respect to the first surface is set to be smaller than the second predetermined angle of the fourth surface with respect to the third surface.

* * * * *